US009487964B1

(12) United States Patent
Mayo et al.

(10) Patent No.: US 9,487,964 B1
(45) Date of Patent: Nov. 8, 2016

(54) BUILDING STRUCTURAL ASSEMBLY SYSTEM

(71) Applicants: John L. Mayo, Penn Valley, CA (US); Gilbert A. Petersen, Weimar, CA (US)

(72) Inventors: John L. Mayo, Penn Valley, CA (US); Gilbert A. Petersen, Weimar, CA (US)

( * ) Notice: Subject to any disclaimer, the term of this patent is extended or adjusted under 35 U.S.C. 154(b) by 0 days.

(21) Appl. No.: 14/848,397

(22) Filed: Sep. 9, 2015

Related U.S. Application Data

(60) Provisional application No. 62/048,852, filed on Sep. 11, 2014.

(51) Int. Cl.

| | |
|---|---|
| ***E04H 6/30*** | (2006.01) |
| ***E04H 6/12*** | (2006.01) |
| ***E04H 6/42*** | (2006.01) |
| ***E04H 6/10*** | (2006.01) |
| *E04B 1/24* | (2006.01) |

(52) U.S. Cl.
CPC ..... *E04H 6/426* (2013.01); *E04H 6/10* (2013.01); *E04H 6/12* (2013.01); *E04B 2001/2466* (2013.01)

(58) Field of Classification Search
CPC ..... E04H 6/424; E04H 6/426
USPC ..... 52/236.3, 650.3; 104/48, 126
See application file for complete search history.

(56) References Cited

U.S. PATENT DOCUMENTS 1,363,442 A * 12/1920 Swern ..... E04H 6/40 105/156
1,771,022 A * 7/1930 Wachs ..... E04H 6/14 198/797
2,303,656 A * 12/1942 Orr ..... E04H 6/26 414/233
2,569,393 A * 9/1951 Walker ..... E04H 6/245 414/234
2,752,051 A * 6/1956 Strahm ..... E04H 6/186 414/254
2,936,082 A * 5/1960 Alimanestiano ..... E04H 6/225 212/71
3,348,710 A * 10/1967 James ..... B60P 3/077 294/67.1
3,554,389 A * 1/1971 Bright ..... B65G 1/04 414/234
3,608,745 A * 9/1971 Pohl ..... B65G 17/002 198/465.1
3,984,012 A * 10/1976 Ennis ..... E04H 6/20 414/231
4,264,257 A * 4/1981 Saurwein ..... E04H 6/287 414/253
4,738,579 A * 4/1988 Byrd ..... E04H 6/188 187/410
4,986,714 A * 1/1991 Fernstrom ..... E04H 6/182 414/240
5,009,559 A * 4/1991 Tsay ..... E04H 6/22 414/253
5,013,203 A * 5/1991 Wakabayashi ..... B61J 1/10 104/35
5,018,926 A * 5/1991 Sternad ..... E04H 6/245 414/232
5,116,182 A * 5/1992 Lin ..... E04H 6/186 414/254
5,190,427 A * 3/1993 Lai ..... E04H 6/22 414/236
5,297,918 A * 3/1994 Ding ..... E04H 6/225 414/232

(Continued)

*Primary Examiner* — Robert Canfield
(74) *Attorney, Agent, or Firm* — Thomas R. Lampe

(57) ABSTRACT

A building structural assembly system including a building framework and a plurality of module structures fabricated off site and installed at the building site, the module structures including shuttle rail module structures.

10 Claims, 6 Drawing Sheets

(56) References Cited

U.S. PATENT DOCUMENTS 5,314,284 A * 5/1994 Tsai ..... E04H 6/282 414/227
5,331,781 A * 7/1994 Gilbert ..... E04H 6/225 414/235
5,467,561 A * 11/1995 Takaoka ..... B60S 13/02 187/266
5,497,854 A * 3/1996 Fang ..... E04H 6/06 187/209
5,556,246 A * 9/1996 Broshi ..... B65G 1/0478 414/239
5,573,364 A * 11/1996 Schneider ..... E04H 6/282 414/234
5,669,753 A * 9/1997 Schween ..... E04H 6/287 414/239
5,690,462 A * 11/1997 Fan ..... E04H 6/245 187/207
5,893,696 A * 4/1999 Belinsky ..... E04H 6/225 414/253
6,077,017 A * 6/2000 Durant ..... E04H 6/186 414/254
6,491,488 B1 * 12/2002 Vita ..... E04H 6/225 414/234
2002/0146305 A1 * 10/2002 Haag ..... E04H 6/225 414/228
2005/0220594 A1 * 10/2005 Haag ..... E04H 6/22 414/529
2008/0101882 A1 * 5/2008 Neland ..... E04H 6/225 410/2
2010/0017016 A1 * 1/2010 Zangerle ..... E04H 6/225 700/214
2010/0034626 A1 * 2/2010 Reiniger ..... E04H 6/183 414/253
2010/0086385 A1 * 4/2010 Shani ..... E04H 6/245 414/232
2010/0119338 A1 * 5/2010 Webster ..... E04H 6/18 414/239
2010/0183409 A1 * 7/2010 Checketts ..... B60K 17/30 414/231
2011/0182703 A1 * 7/2011 Alan ..... E04H 6/183 414/231
2011/0320035 A1 * 12/2011 Kharkover ..... E04H 6/225 700/218
2013/0134290 A1 * 5/2013 Zhu ..... F16M 11/20 248/678
2013/0166105 A1 * 6/2013 Wastel ..... E04H 6/24 701/2

* cited by examiner

BUILDING STRUCTURAL ASSEMBLY SYSTEM

This application is based on and claims the benefit of U.S. Provisional Patent Application No. 62/048,852, filed Sep. 11, 2014.

TECHNICAL FIELD

This invention relates to a building structural assembly system, more particularly a multi-story building in the form of a parking garage including an assemblage of module structures pre-fabricated off site and installed at the building site, and a method employed in the construction of the structural modules and installation at the building site.

BACKGROUND OF THE INVENTION

Multi-level (multi-story) parking garages are well known structures, some being independent buildings dedicated exclusively to that use. Conventionally, such structures are largely comprised of concrete, either precast or formed on site, the concrete structures including, for example, concrete structural wall panels, interior and exterior columns, structural floors, girders, wall panels, stairs and slabs.

Prior art parking garages of the type just described typically rely on use of a driver to park and retrieve the vehicles, although automated multi-story car parks are known.

DISCLOSURE OF INVENTION

The present invention as disclosed herein relates to combinations of structural elements of a multi-level parking garage structure and modular components thereof, as well as to method of assembly of the modular components and installation thereof.

The multi-level parking garage structure includes a building framework and plurality of module structures positioned on said framework at each of a plurality of levels of said multi-level parking garage, said module structures including shuttle rail module structures constructed off-site, transported to the location of said multi-level parking garage, and installed on said building framework at positions next to parking bay locations defined by said building framework.

The shuttle rail module structure includes a first structural steel Ibeam and a second structural steel Ibeam spaced from and disposed parallel to the first structural steel Ibeam.

A plurality of parallel, double-ended, structural steel cross channels are spaced from one another and extend between and are orthogonal relative to said first and second structural steel Ibeams. The ends of the double-ended structural steel cross channels are welded to the structural steel Ibeams.

A first shuttle rail is spaced from and adjacent to the first structural steel Ibeam extending alongside the first structural steel Ibeam. The first shuttle rail is welded to said structural steel cross channels.

A second shuttle rail spaced from the first shuttle rail is spaced from and adjacent to the second structural steel Ibeam, extending alongside said second structural steel Ibeam. The second shuttle rail is welded to the structural steel cross channels. The first and second structural steel Ibeams and said first and second shuttle rails are parallel.

The invention also encompasses a method of making a shuttle rail module structure prior to installation thereof on a building framework.

The method includes the step of supporting the ends of a plurality of parallel, double-ended, cross channels at uniformly spaced corresponding locations on two spaced elongated supports with the cross channels extending between the elongated supports.

The ends of the cross channels are maintained at the uniformly spaced corresponding locations.

First and second structural steel Ibeams are then positioned on the cross channels.

The positions of the first and second structural steel Ibeams are adjusted relative to the cross channels while movement of said cross channels is prevented so that the first and second structural steel Ibeams are parallel to one another.

Lateral forces are applied to the first and second structural steel Ibeams while on the cross channels and while movement of the cross channels is prevented to maintain the structural steel Ibeams parallel, straight and true.

Two shuttle rails are positioned on said cross channels between the Ibeams.

The positions of the shuttle rails on the cross channels are adjusted so that the two shuttle rails are parallel to the Ibeams and to one another and the shuttle rails engage the cross channels at predetermined locations on the cross channels. The shuttle rails are maintained at the predetermined locations on the cross channels.

While maintaining the shuttle rails at the predetermined locations on the cross channels, shuttle rails are welded to the cross channels at the predetermined locations.

Either before or after the step of positioning the shuttle rails on the cross channels, the structural steel Ibeams are welded to the cross channels.

The completed multi-story parking garage structure incorporating framework and features of the present invention would be adapted for automatic parking and formed of structural steel modules constructed off site and secured together at the building site. The framework when completed defines parking bay locations and accommodates shuttle rail module structures of the present invention.

The assembled parking garage will be stable and strong, as well as lighter and less expensive than conventional concrete multi-story garages, allowing for use of a foundation far less extensive and expensive than traditional foundations. Offsite fabrication of modular components also provides operating efficiencies and lower cost as compared with total fabrication at building sites.

Other features, advantages and objects of the present invention will become apparent with reference to the following description and accompanying drawings.

MODES FOR CARRYING OUT THE INVENTION

Figure 1:
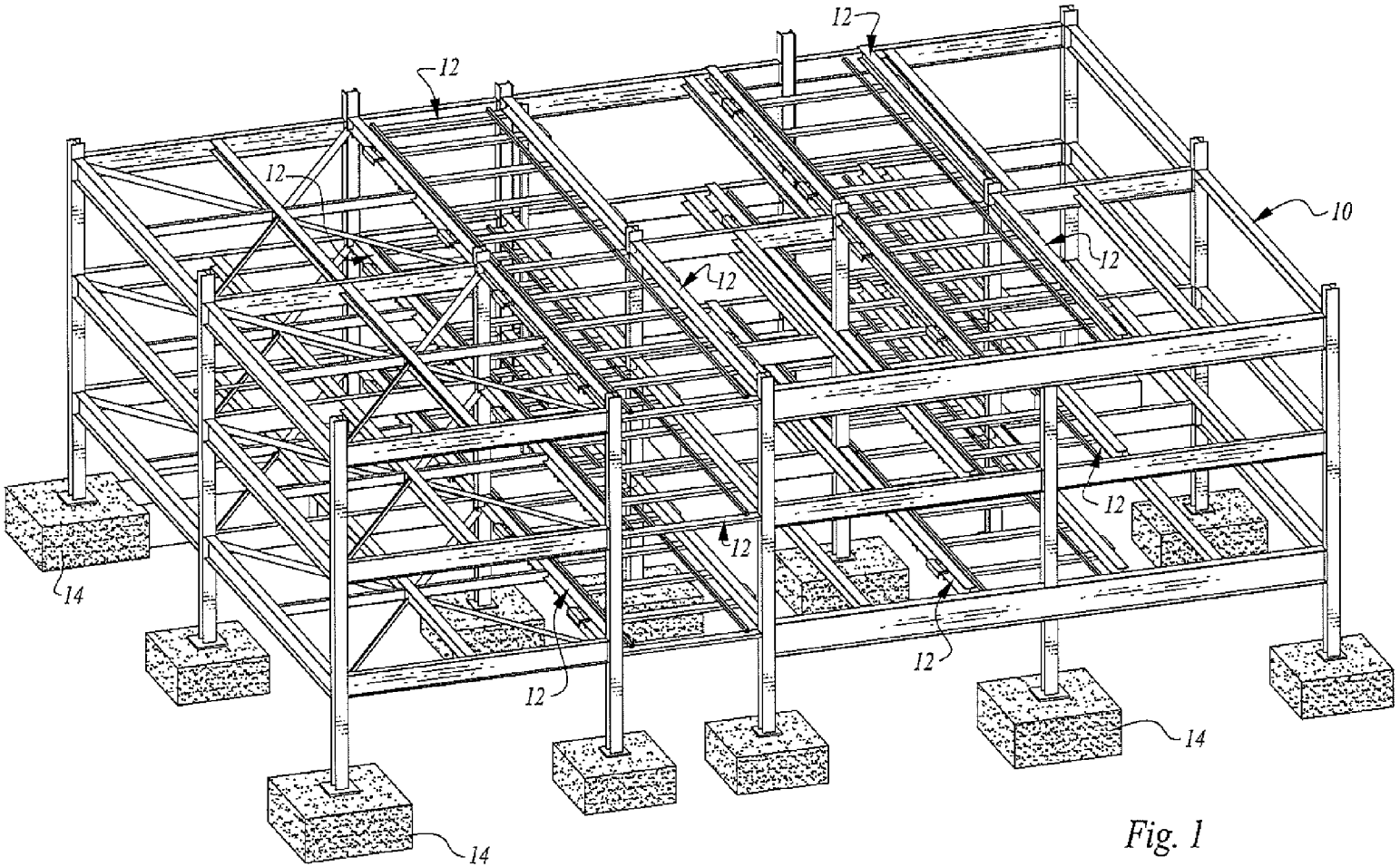
FIG. 1 is a perspective view of a representative partial portion of the building framework of a multi-level parking garage having shuttle rail module structures of the present invention attached thereto.

Referring now to the drawings, FIG. 1 shows a multi-level garage structure including a building framework 10 and a plurality of shuttle rail module structures 12 constructed in accordance with the teachings of the present invention mounted on the framework and located at a plurality of levels thereof. The illustrated building framework 10 is only a representative portion of the framework of a completed multi-level parking garage structure.

The framework comprises, as is conventional, a plurality of attached columns and beams. In the arrangement illustrated, support columns of the structure extend upwardly from an equal number of concrete foundation structures 14.

Figure 2:
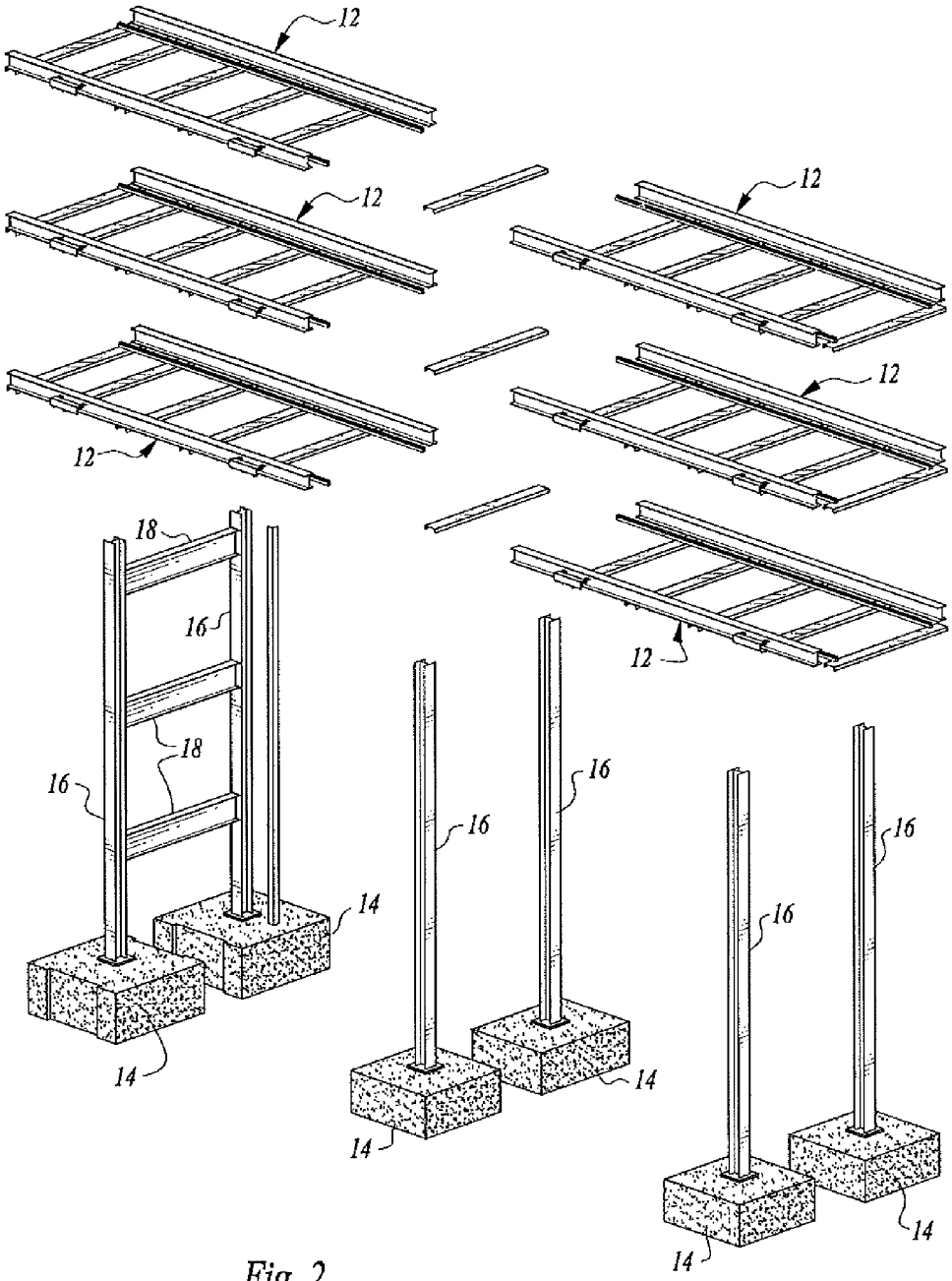
FIG. 2 is an exploded perspective view illustrating six shuttle rail module structures constructed in accordance with the teachings of the present invention with associated framework and foundation components.

In the arrangement illustrated, and with additional reference to FIG. 2, the upstanding columns are identified by reference numeral 16 and representative beams between two of the columns are designated by reference numeral 18. Three levels of the building framework portion shown in FIG. 1 accommodate a plurality of shuttle rail module structures 12.

The building framework 10 defines a plurality of parking bay locations, the actual completed garage parking bays not being shown, the garage being in unfinished form. Parking bay structures per se are well known structures. In the illustrated arrangement two shuttle rail module structures are disposed end to end and are installed on the building framework at positions next to a plurality of parking bay locations.

According to the teachings of the present invention, the shuttle rail module structures 12 are constructed off-site, transported to the location of the multi-level parking garage, and installed on the building framework at positions next to parking bay locations defined by the building framework. The numbers and lengths of the shuttle rail module structures may vary and extend alongside any suitable number of parking bays of the multi-level parking garage. Typically, parking bays would be lined up on both sides of the shuttle rail module structures.

Figure 13:
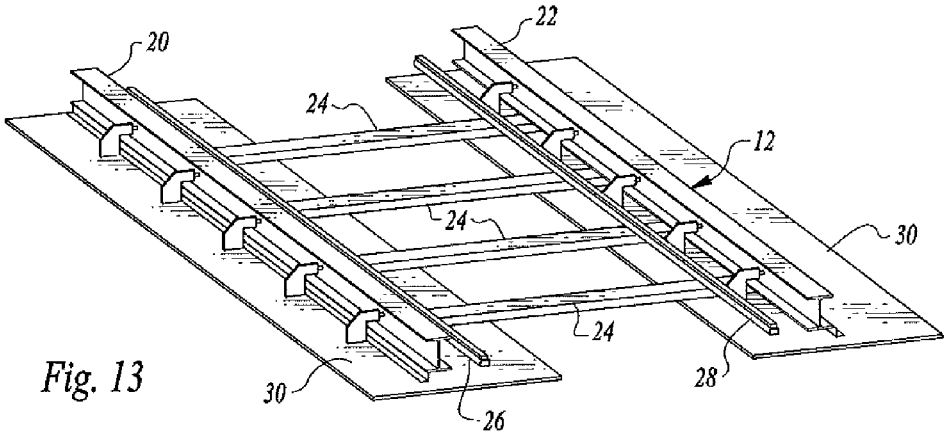

FIG. 13 shows an assembled shuttle rail module structure 12. The depiction is not to scale. Shuttle rail module structure 12 includes two structural steel Ibeams 20 and 22 which are suitably, for example, W10X45 steel Ibeams.

The Ibeams are parallel and coextensive.

The Ibeams 20, 22 are supported by and attached to a plurality of parallel, double-ended, structural steel cross channels 24 (suitably C10 channels) spaced from one another and extending between and orthogonal relative to the Ibeams 20, 22. The ends of the cross channels 24 are welded to the Ibeams.

The shuttle rail module structure 12 also includes shuttle rails 26, 28. Shuttle rail 26 is spaced from and adjacent to structural steel Ibeam 20 and extends alongside thereof. The shuttle rail 26 is welded to the cross channels 24.

Shuttle rail 28 is spaced from shuttle rail 26 adjacent to the structural steel Ibeam 22 and extends alongside Ibeam 22. The shuttle rail 28 is welded to the cross channels 24. The Ibeams 20, 22 and the shuttle rails 26, 28 are parallel.

FIGS. 3-7 illustrate sequential initial stages of the assembly of a shuttle rail module structure 12 in accordance with the teachings of the present invention.

Figure 3:
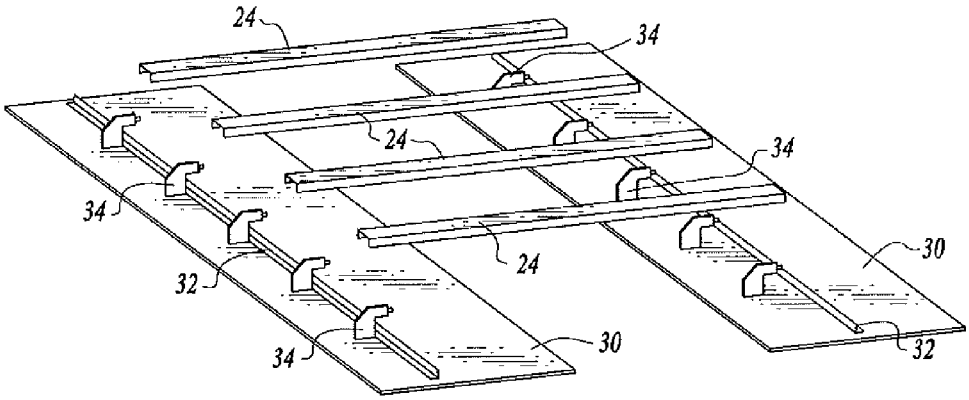
FIGS. 3-5 are perspective views illustrating placement of cross channels and Ibeams at sequential initial stages of fabrication of a shuttle rail module structure in accordance with the teachings of the present invention.

FIG. 3 illustrates two spaced elongated supports 30, suitably jig tables, employed during the fabricating process. Cross channels 24 are positioned on the elongated supports 30. The ends of the cross channels engage the supports 30 and the cross channels extend across the space between the supports. The ends of the cross channels are supported at preselected uniformly spaced corresponding locations on the elongated supports. Suitable stops, such as angle members 32 (see FIGS. 6 and 7), are utilized to maintain the channels on the elongated supports and maintain them at the selected locations.

Figure 4:
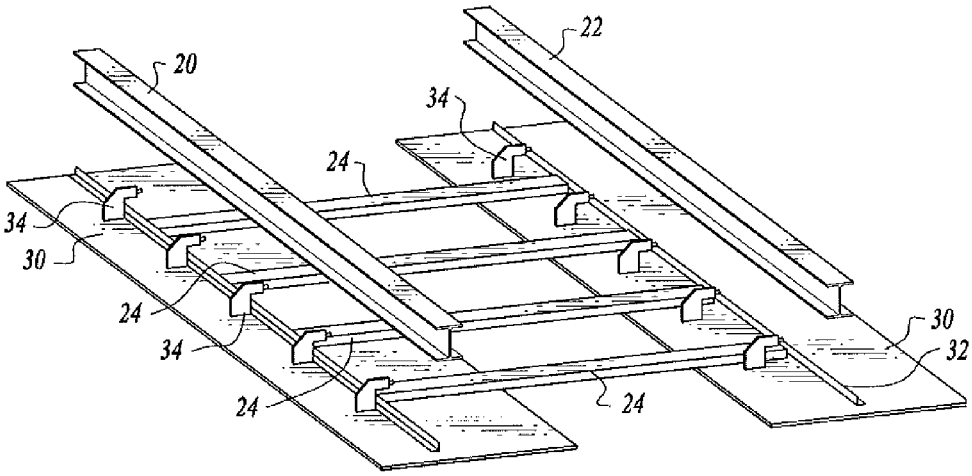
Figure 5:
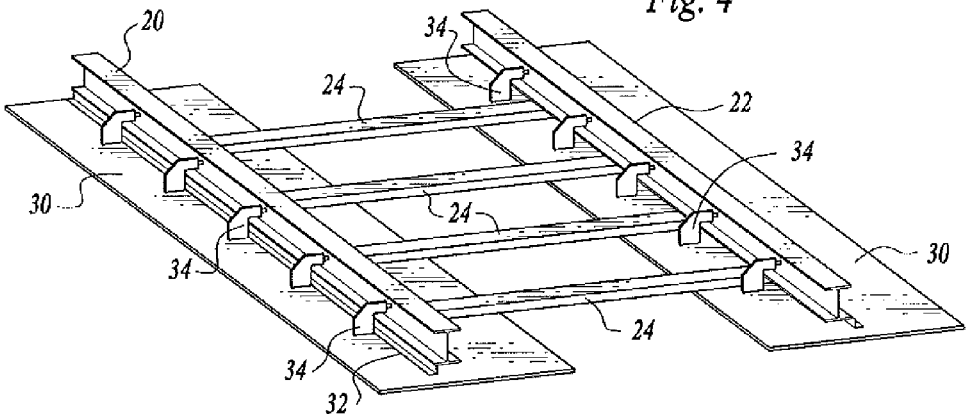

FIG. 4 illustrates positioning of the Ibeams 20, 22 on the cross channels 24. FIG. 5 shows the Ibeams in contact with the cross channels. The positions of the structural steel beams relative to the cross channels are adjusted while preventing movement of the cross channels so that the Ibeams are parallel to one another.

Figure 6:
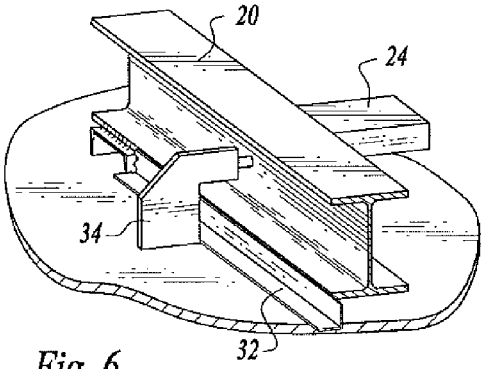
FIGS. 6 and 7 are enlarged, partial sectional perspective views showing placement of Ibeam ends relative to a cross channel and adjustable stops on supports.
Figure 7:
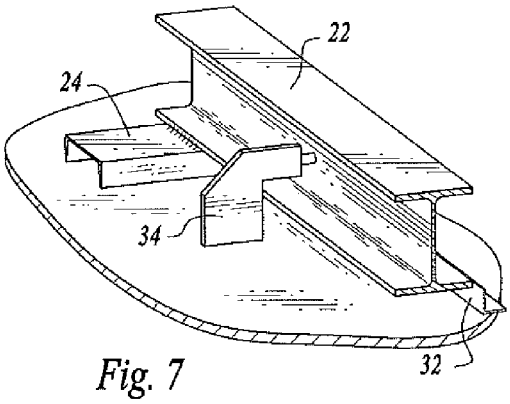

Attached to the elongated supports and extending upwardly therefrom are adjustable stops 34 which engage sides of the Ibeams as shown in FIGS. 5 and 6. Hydraulic rams (not shown) or any other suitable positioning structure may be employed to position the Ibeams against the adjustable stops, the latter applying lateral stop forces to the steel Ibeams while on the cross channels and while movement of the cross channels is prevented to maintain the structural steel Ibeams parallel, straight and true. FIG. 6 shows an adjustable stop 34 engaging Ibeam 20 and FIG. 7 shows an adjustable stop 34 engaging Ibeam 22 at opposite ends of a cross channel 34.

Once the Ibeams are in place on the cross channels and are parallel, straight and true, the Ibeams and cross members are welded together. FIGS. 6 and 7 illustrate welds at the junctures of the two rails and the opposite ends of the same cross channel.

Figure 8:
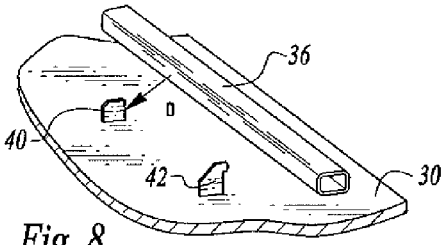
FIGS. 8-11 are enlarged, partial perspective views illustrating consecutive stages in the fabrication of a shuttle rail in accordance with the teachings of the present invention.
Figure 9:
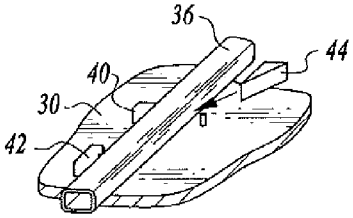
Figure 12:
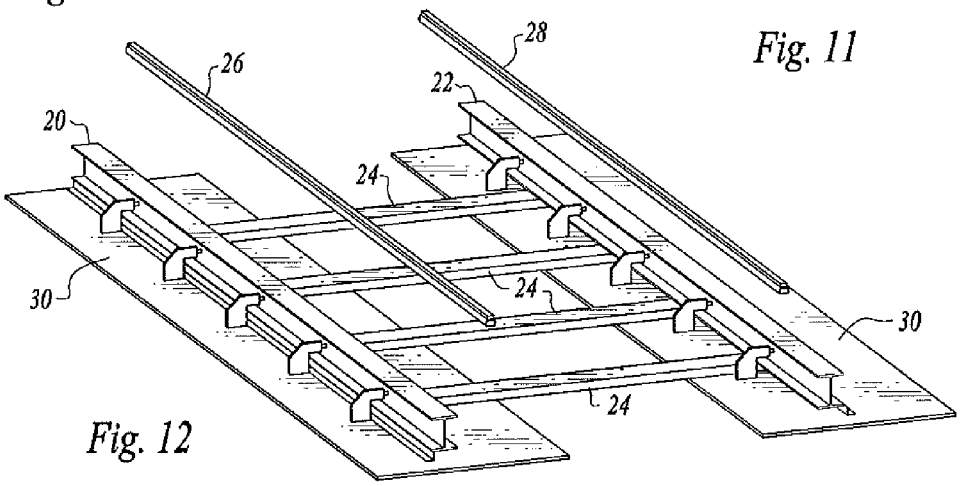
FIGS. 12 and 13 are perspective views illustrating sequential stages in the placement and positioning of shuttle rails relative to the support channels and Ibeams.

FIG. 12 shows the shuttle rails 26 in the process of being positioned on the cross channels after the Ibeams are in place. The shuttle rails are previously each formed by combining and attaching together a high strength steel tube 36 and a steel bar 38. FIG. 8 shows tube 36 being moved toward spaced stops 40, 42 projecting upwardly from support 30. These stops are disposed along the length of the tube. FIG. 9 shows a wedge 44 being positioned to urge the tube into engagement with the stops to keep it fixed, straight and true.

Figure 10:
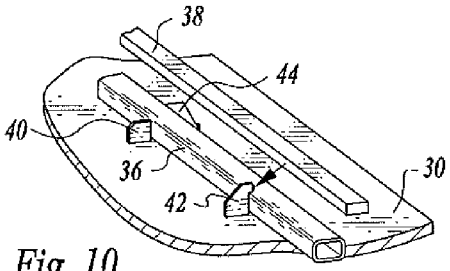

FIG. 10 shows a steel bar being positioned on top of the tube and positioned against stop 42 which is an adjustable stop to maintain the bar straight and properly positioned on the tube.

The high strength steel tube has a generally rectangular cross section with a flat upper surface to which the bar is skip welded. See FIG. 11.

Figure 11:
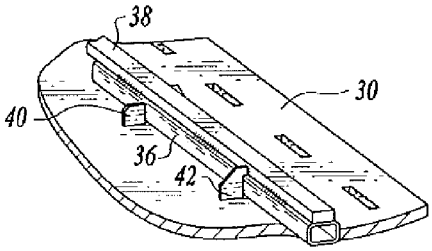

The high strength steel tube is pre-marked (for example by a story stick) to show skip welding locations prior to skip welding of the elongated high strength steel tube and the elongated steel bar as shown in FIG. 11.

Figure 14:
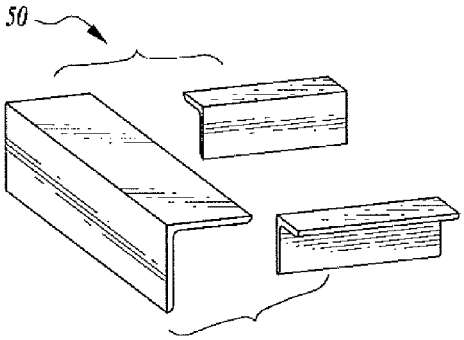
FIG. 14 is an exploded perspective view of a fabrication aid that may be employed to maintain the shuttle rail module structure components aligned during fabrication.
Figure 15:
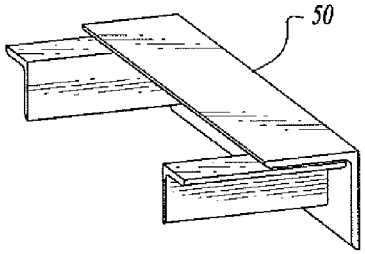
FIG. 15 is a perspective view of the fabrication aid.
Figure 16:
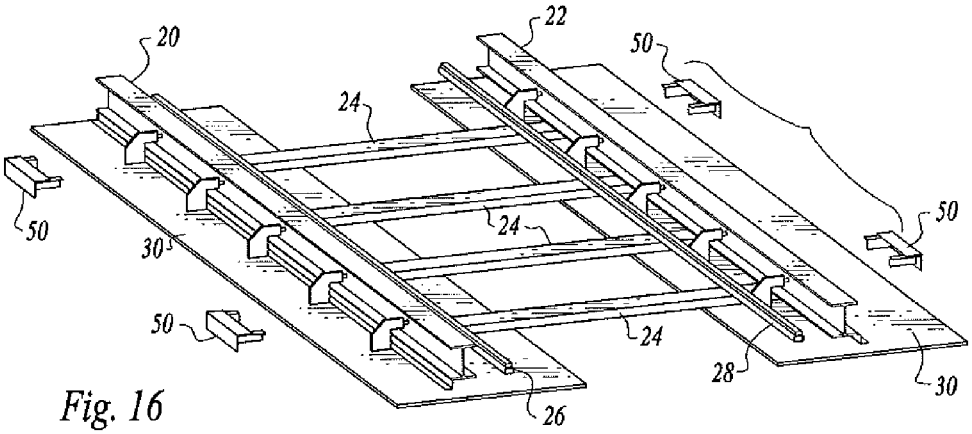
FIG. 16 is a view similar to FIG. 13, but also illustrating a plurality of fabrication aids preparatory to engagement with Ibeams of the shuttle rail module structure.
Figure 17:
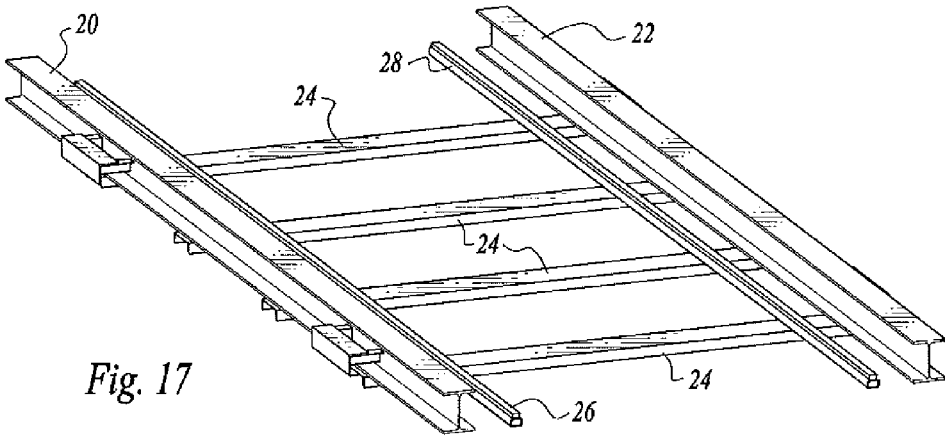
FIG. 17 illustrates the fabrication aids engaging the Ibeams.

Rather than use hydraulic rams, wedges and the like to maintain alignment of the shuttle rail module structure, supplemental structures useful as fabrication aids may be attached. For example, FIGS. 14 and 15 show a structural steel bracket 50 which may be fabricated and attached to the Ibeams as shown in FIGS. 16 and 17.

Figure 18:
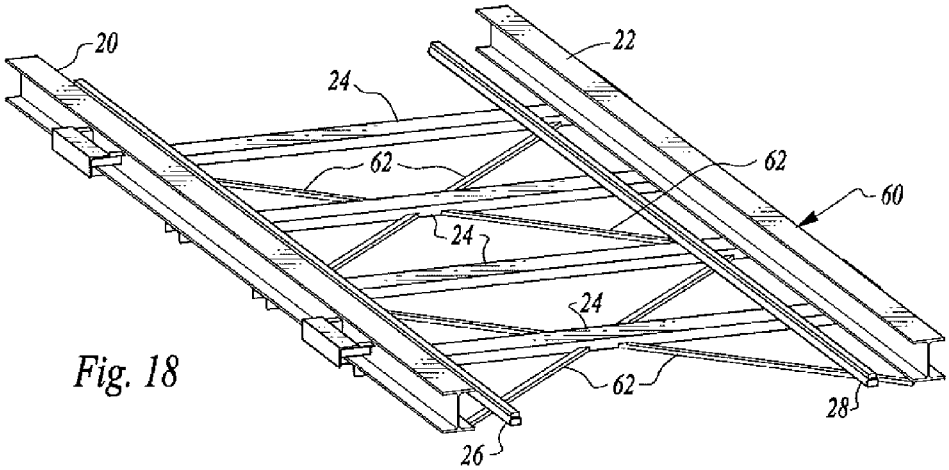
FIG. 18 is a view similar to FIG. 17, but illustrating a second embodiment of the invention in which cross bracing is utilized in the shuttle rail module structure.
Figure 19:
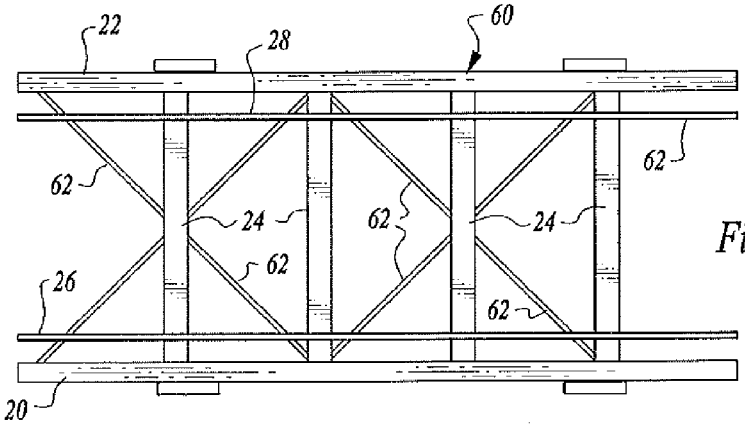
FIG. 19 is a top plan view of the second embodiment.

FIGS. 18 and 19 show an alternative embodiment shuttle rail module structure 60 which has the same structural elements employed in the first embodiment and additionally utilizes cross bracing attached to and extending laterally between the Ibeams and adjacent double-ended structural steel cross channels 24. The bracing suitably comprises a plurality of attached high strength steel tubes 62.

The invention claimed is:

1. A shuttle rail module structure for installation on and attachment to a building framework of a multi-level parking garage at each of a plurality of levels of said multi-level parking garage, said building framework defining a plurality of parking bay locations at each of said plurality of levels, said shuttle rail module structure comprising:

a first structural steel Ibeam;

a second structural steel Ibeam spaced from and disposed parallel to said first structural steel Ibeam;

a plurality of parallel, double-ended, structural steel cross channels spaced from one another and extending between and orthogonal relative to said first and second structural steel Ibeams, each of said plurality of double-ended structural steel cross channels having ends welded to said first and second structural steel Ibeams;

a first shuttle rail spaced from and adjacent to said first structural steel Ibeam extending alongside said first structural steel Ibeam, said first shuttle rail welded to said structural steel cross channels; and a second shuttle rail spaced from said first shuttle rail spaced from and adjacent to said second structural steel Ibeam extending alongside said second structural steel Ibeam, said second shuttle rail welded to said structural steel cross channels, said first and second structural steel Ibeams and said first and second shuttle rails being parallel, each of said first and second shuttle rails including a steel tube of rectangular cross-section having steel tube ends and an upper steel tube surface, and a steel bar welded to the upper steel tube surface, projecting upwardly therefrom, and extending completely between said steel tube ends.

2. The shuttle rail module structure according to claim 1 additionally comprising cross bracing attached to and extending laterally between said first and second structural steel Ibeams and between adjacent double-ended structural steel cross channels of said plurality of double-ended structural steel cross channels.

3. The shuttle rail module structure according to claim 1 attached together end to end to one or more shuttle rail module structures during installation on and attachment to the building framework whereby the attached shuttle rail module structures extend past a plurality of parking bay locations defined by said building framework at each of said plurality of levels.

4. The shuttle rail module structure according to claim 1 wherein the first and second structural steel Ibeams are W10X45 steel Ibeams and wherein the plurality of double-ended structural steel cross channels are C10 channels.

5. The shuttle rail module structure according to claim 2 wherein said cross bracing comprises a plurality of attached steel tubes.

6. A multi-level parking garage structure including a building framework and a plurality of shuttle rail module structures positioned on and attached to said building framework at each of a plurality of levels of said multi-level parking garage, said building framework defining a plurality of parking bay locations at each of said plurality of levels, said shuttle rail module structures constructed off-site, transported to the location of said multi-level parking garage, and installed on said building framework at positions next to said parking bay locations, and each of said shuttle rail module structures comprising:

a first structural steel Ibeam;

a second structural steel Ibeam spaced from and disposed parallel to said first structural steel Ibeam;

a plurality of parallel, double-ended, structural steel cross channels spaced from one another and extending between and orthogonal relative to said first and second structural steel Ibeams, each of said plurality of double-ended structural steel cross channels having ends welded to said first and second structural steel Ibeams;

a first shuttle rail spaced from and adjacent to said first structural steel Ibeam extending alongside said first structural steel Ibeam, said first shuttle rail welded to said structural steel cross channels; and a second shuttle rail spaced from said first shuttle rail spaced from and adjacent to said second structural steel Ibeam extending alongside said second structural steel Ibeam, said second shuttle rail welded to said structural steel cross channels, said first and second structural steel Ibeams and said first and second shuttle rails being parallel, each of said first and second shuttle rails including a steel tube of rectangular cross-section having an upper steel tube surface and a steel bar welded to the upper steel tube surface, projecting upwardly therefrom, and extending completely between said steel tube ends.

7. The multi-level parking garage structure according to claim 6 wherein said shuttle rail module structures each additionally comprise cross bracing attached to and extending laterally between said first and second structural steel Ibeams and between adjacent double-ended structural steel cross channels of said plurality of double-ended structural steel cross channels.

8. The multi-level parking garage structure according to claim 6 wherein a plurality of said shuttle module structures are attached together end to end and extend past a plurality of parking bay locations defined by said building framework at each of said plurality of levels.

9. The multi-level parking garage structure according to claim 6 wherein the first and second structural steel Ibeams are W10X45 steel Ibeams and wherein the plurality of double-ended, structural steel cross channels are C10 channels.

10. The shuttle rail module structure according to claim 7 wherein said cross bracing comprises a plurality of attached steel tubes.

* * * * *